US007100790B2

(12) United States Patent
Dark

(10) Patent No.: US 7,100,790 B2
(45) Date of Patent: Sep. 5, 2006

(54) SPILL-RESISTANT METERED FLOW CAP FOR A CUP

(76) Inventor: Richard C. G. Dark, 11060 Rose Ave., Fontana, CA (US) 92337

( * ) Notice: Subject to any disclaimer, the term of this patent is extended or adjusted under 35 U.S.C. 154(b) by 20 days.

(21) Appl. No.: 10/824,869

(22) Filed: Apr. 15, 2004

(65) Prior Publication Data

US 2005/0230403 A1 Oct. 20, 2005

(51) Int. Cl.
*A47G 19/22* (2006.01)

(52) U.S. Cl. ..... 220/711; 222/529

(58) Field of Classification Search ..... 220/711, 220/719, 703, 731, 734, 782, 714; 222/502, 222/529, 536, 537

See application file for complete search history.

(56) References Cited

U.S. PATENT DOCUMENTS 3,360,161 A 12/1967 Smith
3,730,399 A 5/1973 Dibrell et al.
3,938,695 A 2/1976 Ruff
4,130,215 A 12/1978 Corey et al.
4,331,255 A 5/1982 Fournier
5,065,880 A * 11/1991 Horner ..... 220/711
5,540,350 A 7/1996 Lansky
5,979,689 A 11/1999 Lansky
6,199,711 B1 * 3/2001 Lansky ..... 220/255
6,305,571 B1 10/2001 Chu
6,488,170 B1 * 12/2002 Johnson ..... 220/254.2
6,523,712 B1 2/2003 McGushion
6,640,992 B1 * 11/2003 Berger et al. ..... 220/603
6,659,302 B1 * 12/2003 Lin ..... 220/254.8
2002/0003145 A1 1/2002 Milan

* cited by examiner

*Primary Examiner*—Lien M. Ngo
(74) *Attorney, Agent, or Firm*—Eric Karich

(57) ABSTRACT

A spill-resistant cap has an annular sidewall, a center portion, a plurality of spaced apart openings, and a plurality of baffles formed over the plurality of spaced apart openings. The annular sidewall has a lip engaging portion adapted for engaging a cup, and a lower end. The center portion closes the lower end of the annular sidewall to cover the opening of the cup, such that the annular sidewall and the center portion together form an upper reservoir. The plurality of spaced apart openings extend through the upper reservoir. Each of the plurality of baffles is formed over one of the plurality of spaced apart openings.

4 Claims, 2 Drawing Sheets

SPILL-RESISTANT METERED FLOW CAP FOR A CUP

BACKGROUND OF THE INVENTION

1. Field of the Invention

This invention relates generally to liquid beverage containers, and more particularly to liquid beverage containers that are spill-resistant and capable of dispensing a liquid at a controlled rate.

2. Description of Related Art

Caps or lids are commonly placed over openings of cups containing liquid beverages to form closed containers, especially prior to transport. Spill-resistant caps are also known that prevent spilling of the liquid beverage while allowing the liquid beverage be consumed. Avoiding such spilling is especially important when the beverage is a hot liquid such as coffee or tea.

Re-usable cups with spill-proof caps intended for use by young children are typically called "training cups." Many training cups have spouts and handles. It has been found that children drinking from training cups with spouts may develop deformed palettes that create speech problems. In addition, children using training cups with handles must learn to use handles, and often throw the training cups down when frustrated during this learning process.

Examples of spill-resistant caps include the following:

Dibrell et al., U.S. Pat. No. 3,730,399, describes a non-spill cap that has two layers, an outer cover section that is secured to the cup, and an inner closure section that is attached to the outer cover section. The outer cover section has a plurality of apertures through its body, and the inner closure section flexes between a sealed configuration, in which the inner closure section seals the apertures of the outer cover section, and an open configuration, in which the inner closure section allows fluid flow through the apertures.

M. B. Smith, U.S. Pat. No. 3,360,161, describes a splash-proof drinking vessel that includes a two layer cap for regulating fluid flow. Each layer of the two layer cap includes apertures to enable fluid flow through the cap. In one embodiment, the two layers are separated, and fluid flow is always possible, although somewhat restricted by the two layers. In other embodiments, the two layers can be rotated with respect to each other, so that in an open position, the apertures are aligned and fluid flow is possible, and in other embodiments the apertures are not aligned, and fluid flow is not possible.

Milan, US 2002/0003145 A1, describes a removable beverage container lid for a beverage container. The lid has a substantially enclosed space defined between an exterior cover and an interior cover. At least one inlet opening is formed with the interior cover through which a hot beverage is to flow into the substantially enclosed space. Attached to the interior cover at the forward edge of the inlet opening is a partition or wall assembly with the height of the partition or wall assembly extending to be located substantially against the exterior cover. The length of the partition or wall assembly is at least equal to the length of the inlet opening. Between the partition or wall assembly and the peripheral edge of the exterior cover is located a gap area. Connected with the gap area is a dispensing opening formed within the exterior cover. Hot beverage is required to flow around the partition or wall assembly and into the gap area prior to flowing through the dispensing opening exteriorly of the beverage container. The wall assembly connects with raised areas on the exterior cover each of which has a groove to permit a small amount of the beverage to flow directly into the gap area.

McGushion, U.S. Pat. No. 6,523,712 B1, describes a spill-resistant lid that includes a mounting portion for gripping the upper rim of the container, a sidewall extending upwardly from the mounting portion, and a top wall having a fluid consumption aperture formed therethrough. A spout descends from the fluid consumption aperture towards the interior of the container to which the lid is mounted. The fluid contained within the container must travel through the spout before exiting the fluid consumption aperture. The geometry of the spout is generally either tubular or hollow frusta-conical. One or more steam venting apertures may be formed through the top wall.

Corey et al., U.S. Pat. No. 4,130,215, describes a spill-resistant cup that includes at least two baffle members positioned within the cup wall. Each baffle is generally annular having a central opening and each baffle contains a plurality of passageways (holes or elongated slots) passing therethrough.

Fournier, U.S. Pat. No. 4,331,255, describes a spill-resistant container cover that includes of a pair of similarly dimensioned discoid sections connected with a flexible hinge. The two sections are oriented so that the second section can be flipped over onto the first so that a peripheral channel on the second section engages over a peripheral channel on the first section to provide a shallow space between the two sections bounded by peripheral seal. An array of small openings are provided in the first section leaving a relatively large contiguous imperforate area in that section. A removable tab is provided for forming a drinking opening in the second section, the tab being positioned so that it is disposed opposite the imperforate area in the first section.

Chu, U.S. Pat. No. 6,305,571 B1, describes a spill-resistant lid device for dispensing fluid contained in a drinking container. A mounting portion is configured to sealingly engage a lip portion of a container. A top cover is coupled to the mounting portion and extends substantially laterally across the container opening when the mounting portion is sealingly engaged with the container lip. The top cover includes a top wall and a bottom wall cooperating to define an interior cavity. The top wall has a drinking port in flow communication with the interior cavity. The bottom wall defines a baffle opening which extends into the interior cavity and is adapted to reduce splashing of fluid through the opening fluid dispensed from the container must pass through the baffle opening and into the interior cavity before passing through the drinking port.

Ruff, U.S. Pat. No. 3,938,695, describes a spill-resistant lid that includes a plurality of apertures to minimize accidental spilling of any liquid in the container, even if the container is jogged, shaken, or moved unevenly so as to cause spillage of its contents when a slosh wave overrides the rim of the container.

Lansky, U.S. Pat. No. 5,540,350, describes a guard for preventing splashing from a drinking container. The guard includes a lower disk having an outer circular rim for engaging the inner face of the sidewall of the drinking container, an upper disk having an outer rim spaced from the drinking container to provide an annular passage between the upper disk and the inner face of the sidewall of the drinking container with which the guard is used, a baffle interposed between the lower disk and the upper disk for functioning to baffle the beverage when the drinking container is in motion and to act as a support for supporting the upper disk from the lower disk, and a passageway is provided through the lower disk to allow passage of the beverage through the lower disk to a position above the lower disk. An upstanding handle is provided on the upper disk and a receptacle is provided on the lower disk to removably receive the handle and permit stacking of the guards.

It would be advantageous to have a cap that doesn't have a spout, is spill-resistant, and dispenses the liquid at a controlled rate.

SUMMARY OF THE INVENTION

The present invention teaches certain benefits in construction and use which give rise to the objectives described below.

The present invention provides a spill-resistant cap for a cup having a lip surrounding an opening. The spill-resistant cap includes an annular sidewall, a center portion, a plurality of spaced apart openings, and a plurality of baffles formed over the plurality of spaced apart openings. The annular sidewall has a lip engaging portion and a lower end. The center portion closes the lower end of the sidewall to cover the opening, such that the annular sidewall and the center portion together form an upper reservoir. The plurality of spaced apart openings extend through the upper reservoir. Each of the plurality of baffles is formed over one of the plurality of spaced apart openings.

A primary objective of the present invention is to provide a cap for a cup, the cap having advantages not taught by the prior art.

Another objective is to provide a spill-resistant cap that resistant to spills.

A further objective is to provide a cap that dispenses a fluid at a controlled rate, without splashing.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
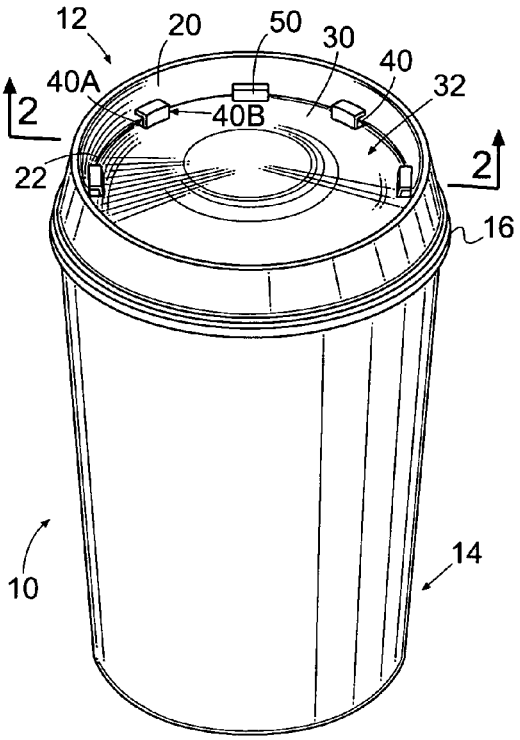
FIG. 1 is a perspective view of one embodiment of a drinking container including a cup and a spill-resistant cap.
Figure 2:
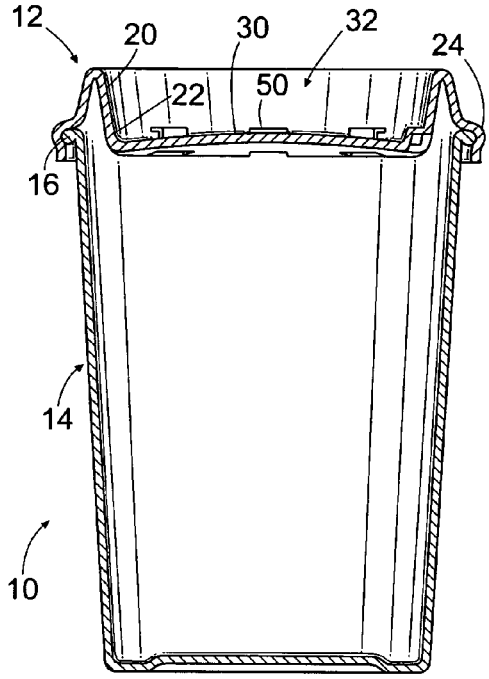
FIG. 2 is a cross-section view thereof taken along line 2—2 in FIG. 1.
Figure 3:
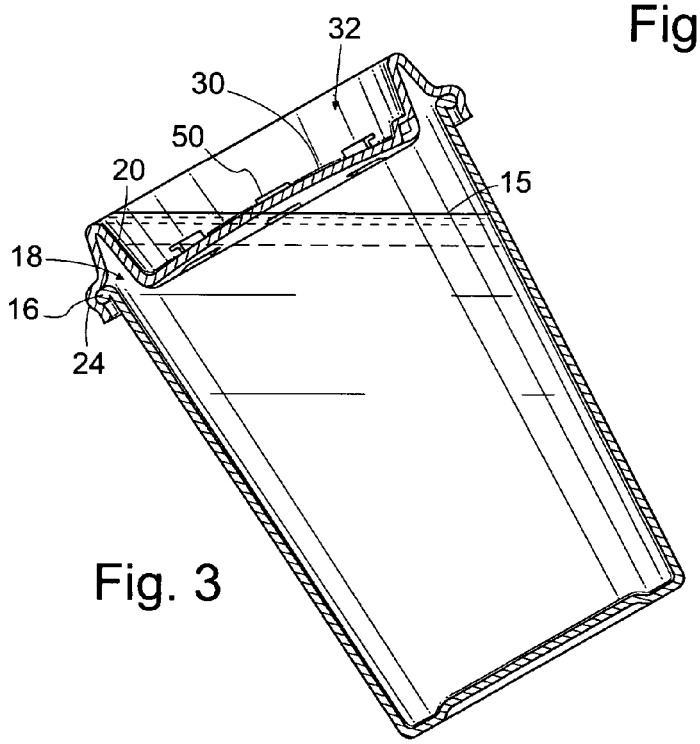
FIG. 3 is the cross-section view of FIG. 2, illustrating how a fluid is dispensed from the drinking container.

FIG. 1 is a perspective view of one embodiment of a drinking container 10 including a spill-resistant cap 12 and a cup 14. As shown in FIGS. 1–3, the cup 14 is provided for holding a liquid (such as a liquid beverage, shown as reference number 15 in FIG. 3), and has a lip 16 that forms an opening 18. The cap 12 is adapted for attaching to the cup 14 adjacent the lip 16 for covering the opening 18. While we show two specific embodiments of the cup, the term cup is hereby defined to include any form of cup, glass, bottle, jar, jug, or other container that is suitable for use with the cap 12 described herein, for the purpose of dispensing a liquid 15. The term cup should not be construed to be limited to any one particular embodiment or use.

As shown in FIGS. 1–3, the cap 12 includes an annular sidewall 20, a center portion 30, a plurality of spaced apart openings 40, and a plurality of baffles 50. The annular sidewall 20 has a lip engaging portion and a lower end 22. The lip engaging portion is adapted to engage the lip 16 of the cup 14. In embodiment of FIGS. 1–3, the lip engaging portion is provided by a generally C-shaped portion 24 that is adapted to frictionally engage the lip 16. Other embodiments of the lip engaging portion are described below. While we describe the sidewall as "annular", this is not meant to limit the structure to a circular shape, but to any functionally similar shape that will mate with the lip 16 of the cup 14.

As shown in FIGS. 1–3, the center portion 30 functions to close the lower end 22 of the annular sidewall 20 to cover the opening, such that the annular sidewall 20 and the center portion 30 together form an upper reservoir 32. The plurality of spaced apart openings 40 extend through the upper reservoir 32, for the controlled dispensing of liquid 15, as described below. The center portion 30 is preferably sloped towards the plurality of spaced apart openings 40, to facilitate the flow of fluid from the upper reservoir 32, through the plurality of spaced apart openings 40, and back into the cup 14, as described in greater detail below.

As shown in FIGS. 1–3, the plurality of baffles 50 are disposed to prevent splashing of the fluid 15 through the plurality of spaced apart openings 40. In the preferred embodiment, each of the plurality of baffles 50 is formed over one of the plurality of spaced apart openings 40. Each of the plurality of baffles 50 is preferably an curving, arching, or otherwise extending sidewall that is spaced from and spans over one of the plurality of spaced apart openings 40 to form a pair of side apertures 40A and 40B on either side of the opening 40. For example, each of the plurality of baffles 50 may span one of the plurality of spaced apart openings 40 from the annular sidewall 20 to the center portion 30, thereby forming the pair of side apertures 40A and 40B on either side of each baffle 50.

In alternative embodiments, the plurality of baffles 50 could also have other shapes and configurations. For example, the plurality of baffles 50 could each extend only from the center portion 30, or the annular sidewall 20. The plurality of baffles 50 could also integrally formed in the shape of each of the plurality of spaced apart openings 40. Such alternatives should be considered within the scope of the present invention, as claimed below.

In use, the drinking container 10 is useful for dispensing the liquid 15 at a controlled rate, without splashing, and is therefore particularly well suited to use by babies or small children, or by adults using drinks such as coffee that can be particularly damaging if spilled.

As shown in FIG. 3, during ordinary use, the drinking container 10 is tilted so that the liquid 15 flows steadily through the plurality of spaced apart openings 40, past the plurality of baffles 50, to slowly fill the upper reservoir 32. The user is able to drink from the upper reservoir 32. Due to the nature of the upper reservoir 32, the user is able to drink from the drinking container 10 from any portion of the cap 12, without having to turn the drinking container 10 to any one particular orientation.

When the user returns the drinking container 10 to an upright position, the liquid 15 flows back down the plurality of spaced apart openings 40 and into the cup 14. The slope of the center portion 30 facilitates the flow of the liquid 15 back into the cup 14.

If the drinking container 10 is turned upside down, so that all of the plurality of spaced apart openings 40 are covered, a vacuum is formed in the cup 14 that advantageously substantially prevents the liquid 15 from exiting the cup 14, preventing a spill. If the drinking container 10 containing a liquid 15 is jarred, the liquid 15 that escapes through the plurality of spaced apart openings 40 is deflected by the plurality of baffles 50 either into the cup 14 or into the upper reservoir 32, from which it drains back into the cup 14.

It is noted that the number and sizes of the plurality of spaced apart openings 40 in the cap 12 are largely determined by a desired flow rate of the liquid 15 from the cup 14 into the upper reservoir 32 when the drinking container 10 is tilted to one side, as shown in FIG. 3. In one embodiment the cap 12 of the drinking container 10 has eight (8) openings 40 (or pairs of side apertures 40A and 40B); however, a wide variety of sizes and numbers could be used. In the preferred embodiment, the drinking container 10 has 6–10 openings 40; and in the most preferred embodiment, the drinking container 10 has 8 openings.

The cap 12 may be made of a rigid material such as plastic, or any other suitable material. The cup 14 may also be made of a molded plastic, or in the alternative, out of paper/cardboard or any other material from which such cups are generally constructed. In the embodiment of FIGS. 1–3, the cap 12 is constructed of a vacuum formed plastic and the cup 14 is constructed of paper or cardboard, and is similar to prior art disposable drinking containers that are used to drink coffee. In this embodiment, the cap 12 is frictionally engaged to the cup 14, as described above.

Figure 4:
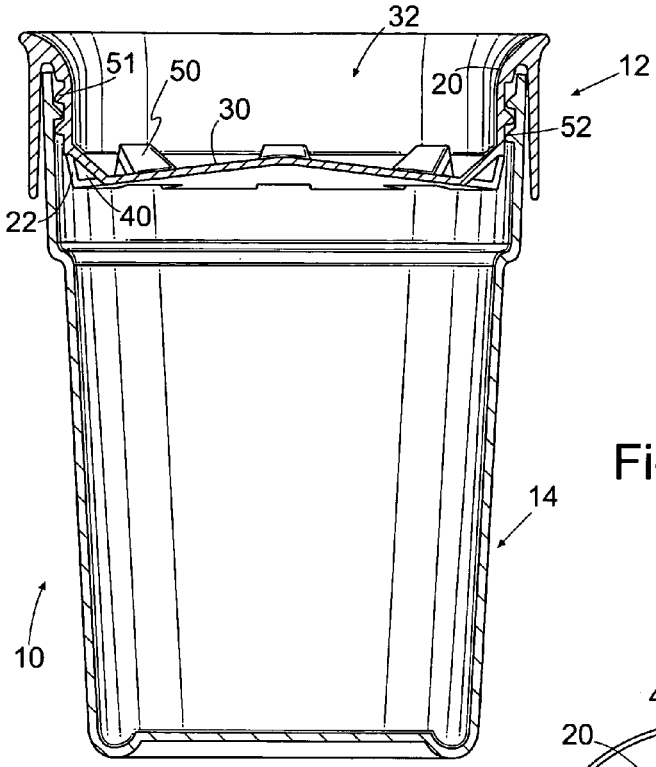
FIG. 4 is cross-section view of another embodiment of the drinking container.
Figure 5:
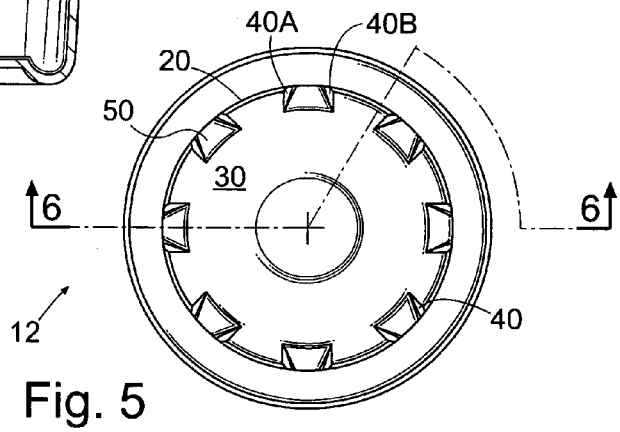
FIG. 5 is a top plan view of the spill-resistant cap of FIG. 4.
Figure 6:
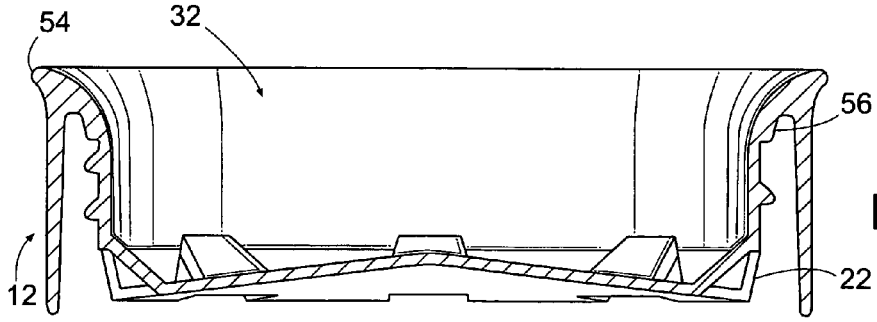
FIG. 6 is a cross-section view thereof taken along line 6—6 in FIG. 5.

In an alternative embodiment, as shown in FIGS. 4–6, the drinking container 10 is a baby training cup. In this embodiment, the lip engaging portion includes an threaded portion 51 on the exterior surface of the annular sidewall 20. The threaded portion 51 is adapted to threadedly engage an internal thread 52 of the cup 14. If course, this terminology should be construed to include the opposite configuration; however, it is preferred that the thread 52 be on the inside of the cup 14 so that the cup 14 can be used without the cap 12, without the thread 52 interfering with the baby's lips during use. In this embodiment, the threaded nature of the connection is preferred because babies routinely drop their cups, and an especially strong connection between the cap 12 and the cup 14 is desired.

As shown in FIG. 6, the cap 12 in this embodiment includes an outer rim 54 that is shaped to extend outwardly to facilitate use of the drinking container 10 by a baby. The annular sidewall 20 further includes a sealing surface 56 that is adapted to sealingly engage the cup 14 to prevent leakage.

In this embodiment, both the cap 12 and the cup 14 are constructed of molded plastic using techniques known in the art. Those skilled in the art will recognize, however, that alternative materials could also be used, and the description of the current preferred embodiments should not be construed to limited the scope of the invention to any one particular material. Rather, the scope of the invention should be considered only in reference to the claims, and should include alternative structures, materials, and elements that would be known to one skilled in the art.

Furthermore, while the present invention has been described as applied to two specific uses, those skilled in the art will also recognize that the inventive concept could also be applied to a wide variety of alternative uses and embodiments, and such alternatives should be considered within the scope of the claimed invention.

While the invention has been described with reference to two preferred embodiments, it is to be clearly understood by those skilled in the art that the invention is not limited thereto. Rather, the scope of the invention is to be interpreted only in conjunction with the appended claims.

What is claimed is:

1. A spill-resistant cap for a cup having a lip surrounding an opening, the spill-resistant cap comprising:

an annular sidewall having a lip engaging portion and a lower end, the lip engaging portion being adapted to engage the lip of the cup;

a center portion closing the lower end of the annular sidewall to cover the opening, such that the annular sidewall and the center portion together form an upper reservoir;

a plurality of spaced apart openings extending through the upper reservoir; and a plurality of baffles, each of the plurality of baffles being formed over one of the plurality of spaced apart openings such that each of the plurality of baffles is spaced from and spans over one of the plurality of spaced apart openings, wherein each of the plurality of baffles spans one of the plurality of spaced apart openings to form a pair of side apertures.

2. The spill-resistant cap as recited in claim 1, wherein each of the plurality of baffles spans one of the plurality of spaced apart openings from the annular sidewall to the center portion.

3. A drinking container for drinking a fluid, the drinking container comprising:

a cup having a lip forming an opening;

a spill-resistant cap having an annular sidewall having a lip engaging portion and a lower end, the lip engaging portion being adapted to engage the lip of the cup;

a center portion closing the lower end of the annular sidewall to cover the opening, such that the annular sidewall and the center portion together form an upper reservoir;

a plurality of spaced apart openings extending through the upper reservoir; and a plurality of baffles, each of the plurality of baffles being formed over one of the plurality of spaced apart openings such that each of the plurality of baffles is spaced from and spans over one of the plurality of spaced apart openings, wherein each of the plurality of baffles spans one of the plurality of spaced apart openings to form a pair of side apertures.

4. The drinking container as recited in claim 3, wherein each of the plurality of baffles spans one of the plurality of spaced apart openings from the annular sidewall to the center portion.

* * * * *